US007918684B2

(12) United States Patent
Lu

(10) Patent No.: US 7,918,684 B2
(45) Date of Patent: Apr. 5, 2011

(54) SHIELD-TYPE COMMUNICATION SOCKET

(75) Inventor: Shan-Jui Lu, Taipei County (TW)

(73) Assignee: Lantek Electronics, Inc., Taipei County (TW)

( * ) Notice: Subject to any disclaimer, the term of this patent is extended or adjusted under 35 U.S.C. 154(b) by 0 days.

(21) Appl. No.: 12/844,914

(22) Filed: Jul. 28, 2010

(65) Prior Publication Data

US 2011/0028026 A1 Feb. 3, 2011

Related U.S. Application Data

(63) Continuation-in-part of application No. 12/556,812, filed on Sep. 10, 2009.

(30) Foreign Application Priority Data

Jul. 28, 2009 (TW) ..... 98213817 U

(51) Int. Cl.
*H01R 4/24* (2006.01)

(52) U.S. Cl. ..... 439/395

(58) Field of Classification Search ..... 439/395, 439/394, 391, 389, 387, 607.01, 607.55, 439/607.56, 904, 906, 404, 417, 467
See application file for complete search history.

(56) References Cited

U.S. PATENT DOCUMENTS

| | | | | |
|---|---|---|---|---|
| 4,538,873 | A * | 9/1985 | Worth | 439/404 |
| 4,932,873 | A * | 6/1990 | La Shier | 439/76.1 |
| 5,957,720 | A | 9/1999 | Boudin | |
| 6,338,653 | B1 * | 1/2002 | Jones et al. | 439/579 |
| 7,413,464 | B1 | 8/2008 | Chen | |

* cited by examiner

*Primary Examiner* — Edwin A. Leon
(74) *Attorney, Agent, or Firm* — Tim Tingkang Xia; Morris, Manning & Martin, LLP

(57) ABSTRACT

A shield-type communication socket includes a housing; a first terminal seat, having a plurality of first terminals; a printed circuit board (PCB), having a plurality of first openings and a plurality of second openings; a plurality of IDC terminals; a second terminal seat; a terminal pressing member; a first pressing cover, rotatably pivoted on one side of the housing; and a second pressing cover, rotatably pivoted on another side of the housing. With the above structure, a cable can be easily accommodated in the communication socket and the plurality of IDC terminals and the plurality of first terminals are securely electrically connected.

5 Claims, 18 Drawing Sheets

SHIELD-TYPE COMMUNICATION SOCKET

CROSS-REFERENCE TO RELATED APPLICATIONS

This application is a continuation-in-part of application Ser. No. 12/556,812 which claims priority under 35 U.S.C. §119(a) on Patent Application No(s). 098213817 filed in Taiwan, R.O.C. on Jul. 28, 2009, the entire contents of which are hereby incorporated by reference.

BACKGROUND OF THE INVENTION

1. Field of Invention

The present invention relates to a communication socket, and more particularly to a shield-type communication socket.

2. Related Art

FIG. 1 is a schematic exploded view of a shield-type communication socket in the prior art. The shield-type communication socket includes a body 200, a terminal pusher 210, and two outer covers 220, 230, in which the outer covers 220, 230 are respectively pivoted on two opposite sides of the body 200. When the terminal pusher 210 is disposed on the body 200, the outer covers 220, 230 respectively rotate in two opposite directions, so as to press the terminal pusher 210 to the body 200 and accommodate the terminal pusher 210 in an accommodation space formed by the body 200 and the outer covers 220, 230. However, the shield-type communication socket in FIG. 1 has the following problems. Since the outer covers 220, 230 are independent elements, when any outer cover, i.e., the outer cover 220 or 230, rotates to contact the terminal pusher 210 and press the terminal pusher 210 towards the body 200, only a part of the signal lines are pressed by the terminal pusher 210 into corresponding Insulation Displacement Contact terminals (IDC terminals), and electrically contact the corresponding IDC terminals.

When the outer cover 220 rotates relative to the outer cover 230 to be covered on the outer cover 230, since the sizes of a semicircular notch 222 of the outer cover 220 and a semicircular notch 232 of the outer cover 230 are fixed, an aperture size of a through hole formed by the semicircular notch 222 and the semicircular notch 232 is fixed.

It should be noted that a cable for the shield-type communication socket normally has eight signal lines. The signal lines are wrapped by a metal mesh to protect the signal lines from electromagnetic interference. However, in order to achieve a better electromagnetic interference prevention effect of the signal lines, a thick cable is further used in the prior art. Besides the above metal mesh, each signal line of the thick cable is also wrapped by an electromagnetic interference prevention mesh. In this manner, when seeking for a better electromagnetic interference prevention effect, a user replaces a cable 240 inserting into the through hole by a thicker cable having an outer diameter larger than the aperture of the through hole, which causes the problem that the outer cover 220 cannot be completely covered on the outer cover 230, and further the travel of the terminal pusher 210 pressed by the outer covers 220, 230 to the body is insufficient. The insufficient travel of the terminal pusher 210 results in that a part of the signal lines cannot completely electrically contact the corresponding IDC terminals.

Furthermore, FIG. 2 shows a shield-type communication socket disclosed in U.S. Pat. No. 7,413,464 B1. The shield-type communication socket in FIG. 2 includes a body 300, a terminal pusher 310, and two outer covers 320, 330. The outer covers 320, 330 are respectively pivoted on two opposite sides of the body 300. When the terminal pusher 310 is disposed on the body 300, the outer covers 320, 330 respectively rotate in two opposite directions, so as to press the terminal pusher 310 to the body 300 and accommodate the terminal pusher 310 in an accommodation space formed by the body 300 and the outer covers 320, 330.

Likewise, the shield-type communication socket of FIG. 2 has the same problems as the shield-type communication socket of FIG. 1, i.e., (1) when any outer cover, i.e., the outer cover 220 or 230, rotates to contact the terminal pusher 210 and press the terminal pusher 210 towards the body 200, only a part of the signal lines are pressed by the terminal pusher 210 into corresponding IDC terminals (IDC), and electrically contact the corresponding IDC terminals; and (2) when seeking for a better electromagnetic interference prevention effect, a user replaces a cable 240 inserting into the through hole by a thicker cable having an outer diameter larger than the aperture size of the through hole, which causes the problem that the outer cover 220 cannot be completely covered on the outer cover 230.

SUMMARY OF THE INVENTION

In order to solve the above problems, the present invention is a shield-type communication socket. When a plurality of signal lines is disposed on a plurality of IDC terminals of the shield-type communication socket, by using one pressing cover, the shield-type communication socket presses all the signal lines to the IDC terminals at a time and makes the signal lines electrically contact the IDC terminals.

In an embodiment of the present invention, the shield-type communication socket comprises a body, a plurality of first IDC terminals, a plurality of second IDC terminals, a terminal pressing member, and a pressing cover. The body has a connector jack on one side thereof. The connector jack comprises a plurality of signal terminals. The first IDC terminals and the second IDC terminals are electrically connected to the signal terminals. The terminal pressing member has a plurality of first clamping slots and second clamping slots on one side thereof. The first clamping slots are located on the first IDC terminals, and the second clamping slots are located on the second IDC terminals. The terminal pressing member has a first protruding portion and a second protrusion on another side thereof. The first protruding portion is located on a central area of the first IDC terminals, and the second protrusion is located on a central area of the second IDC terminals. The pressing cover is pivoted to the body, and has a first pressing surface and a second pressing surface on an inner side thereof. When the terminal pressing member is located at a ready position, the pressing cover is rotated to make the first pressing surface and the second pressing surface respectively press the first protruding portion and the second protrusion, such that the terminal pressing member moves to a combination position.

In an embodiment of the present invention, the first protruding portion has a curved surface. The pressing surface presses the terminal pressing member from the ready position to the combination position along the curved surface.

In an embodiment of the present invention, the first protruding portion comprises a plurality of convex bumps.

In an embodiment of the present invention, a height of the first protruding portion is greater than that of the second protrusion.

In an embodiment of the present invention, the shield-type communication socket further comprises a mobile latching pin. The pressing cover has a notch. The mobile latching pin spans on two opposite side walls forming the notch, such that the mobile latching pin and the notch form a cable insertion hole. The mobile latching pin is disposed on the pressing cover in a manner of being capable of moving relative to the notch, such that the mobile latching pin slides between a closed end and an open end of the notch.

Accordingly, since the first protruding portion is located on the central area of the first IDC terminals, and the second protrusion is located on the central area of the second IDC terminals, in the above embodiment, a single pressing cover may be used to press the first protruding portion and the second protrusion at the same time, and the terminal pressing member is enabled to move from the ready position to the combination position.

In addition, when the shield-type communication socket has the mobile latching pin, since the mobile latching pin is disposed on the pressing cover in a manner of being capable of moving relative to the notch, the structure having the mobile latching pin may adjust the size of the cable insertion hole, and thus the shield-type communication socket having the mobile latching pin is applicable to cables with different thickness.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1:
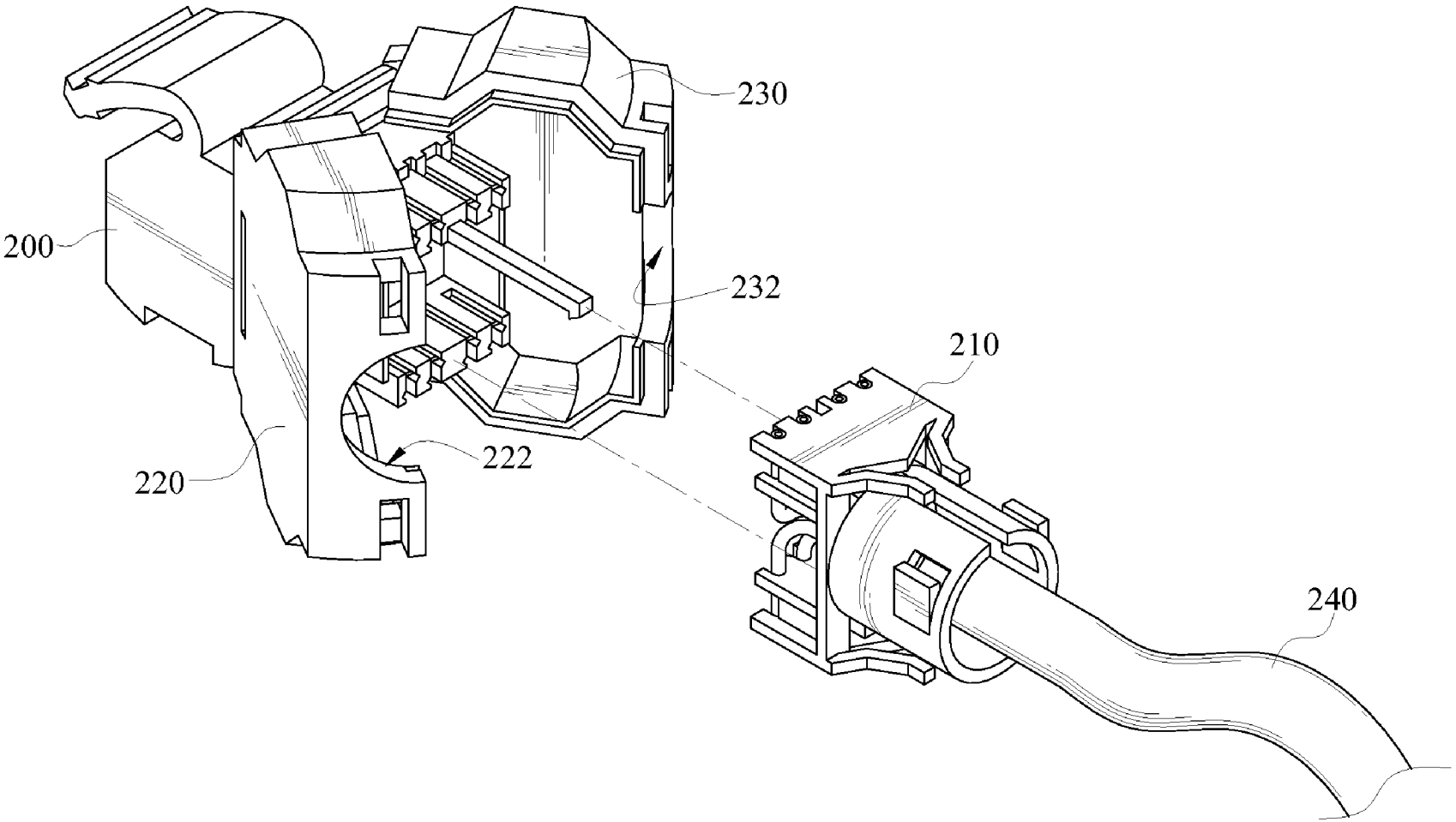
FIG.1 (Prior Art)
FIG. 1 is a schematic exploded view of a shield-type communication socket in the prior art.
Figure 2:
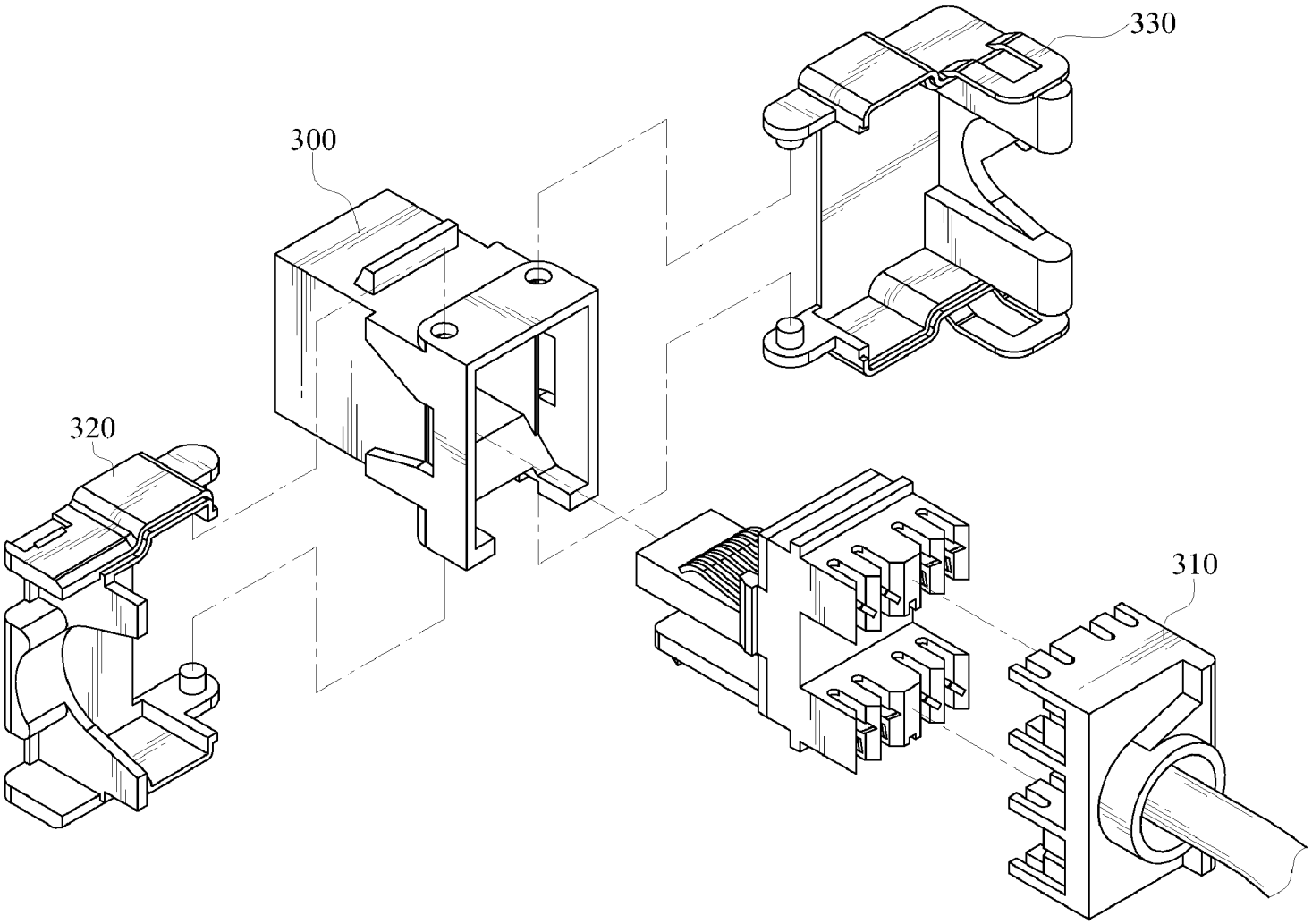
FIG.2 (Prior Art)
FIG. 2 is a schematic exploded view of a shield-type communication socket in another prior art.
Figure 3:
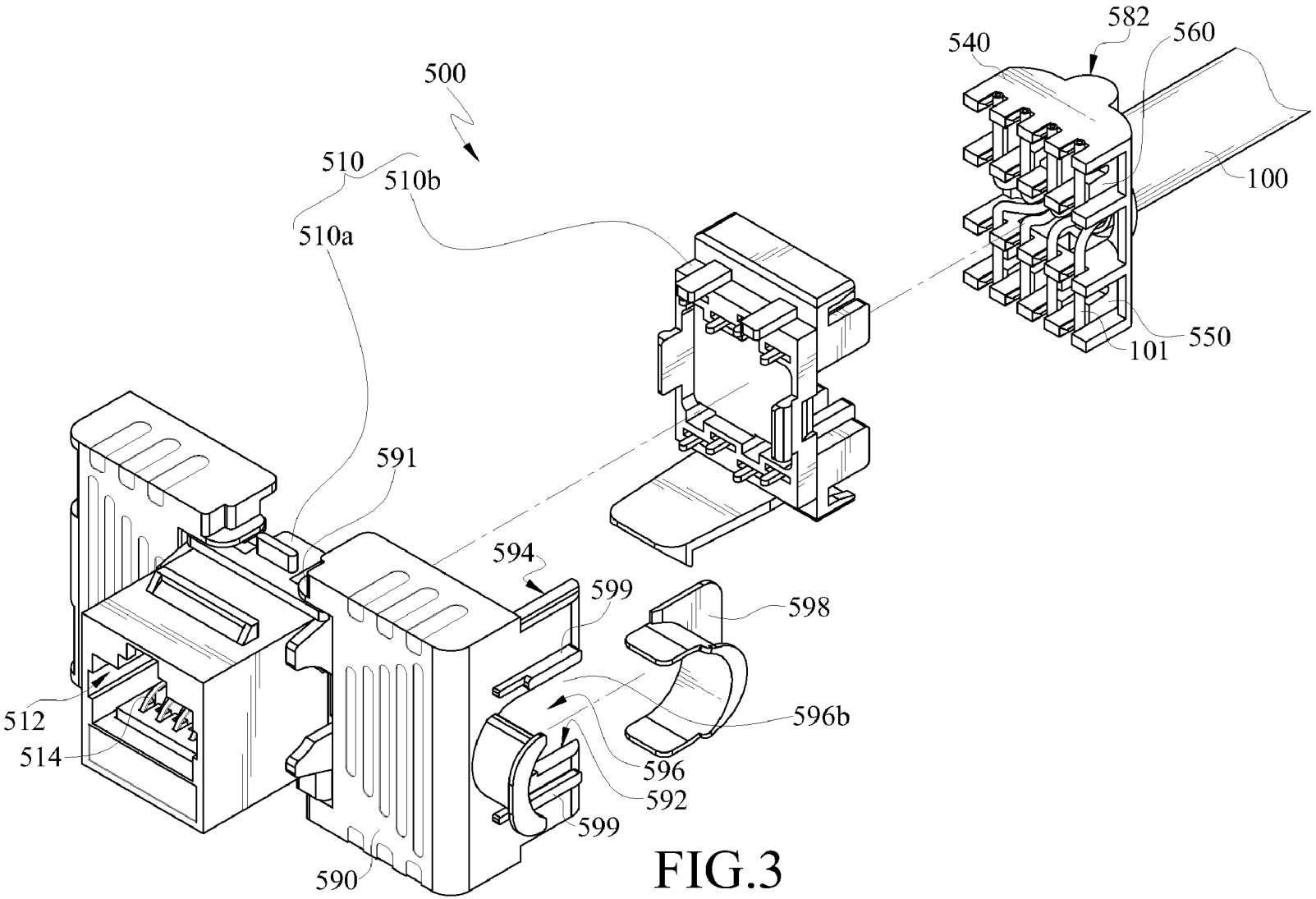
FIG. 3 is a schematic exploded view of a shield-type communication socket with a cable inserted therein taken at an angle of view according to an embodiment of the present invention.
Figure 4:
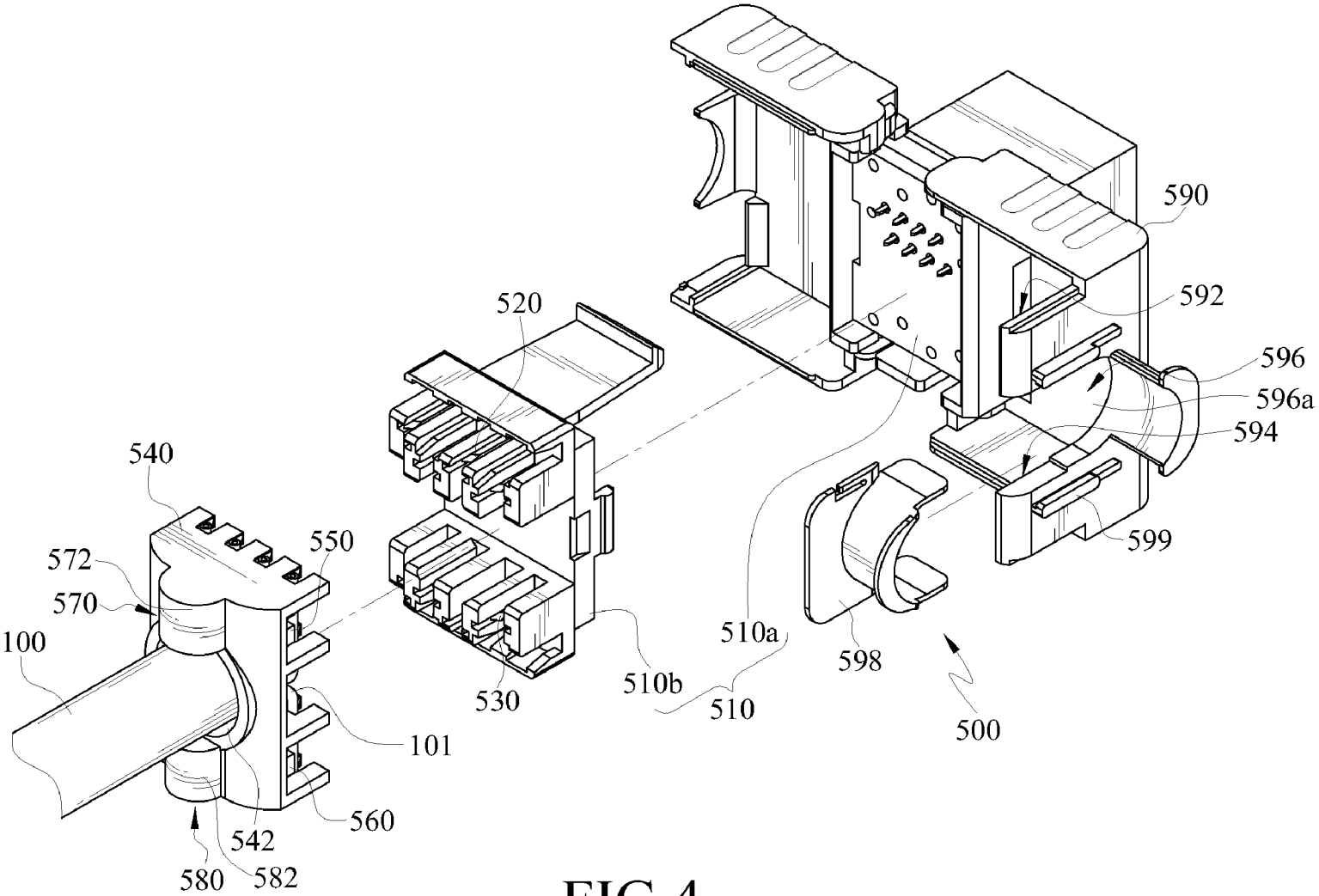
FIG. 4 is a schematic exploded view of the shield-type communication socket of FIG. 3 taken at another angle of view.

FIG. 3 is a schematic exploded view of a shield-type communication socket with a cable inserted therein taken at an angle of view according to an embodiment of the present invention, and FIG. 4 is a schematic exploded view of the shield-type communication socket of FIG. 3 taken at another angle of view.

The shield-type communication socket 500 comprises a body 510, a plurality of first IDC terminals 520, a plurality of second IDC terminals 530, a terminal pressing member 540, and a pressing cover 590. The body 510 comprises a housing 510*a* and a terminal block 510*b* disposed on the housing 510*a*. The body 510 has a connector jack 512 on one side thereof. Specifically, the connector jack 512 is located on the housing 510*a*. The connector jack 512 comprises a plurality of signal terminals 514. The first IDC terminals 520 and the second IDC terminals 530 stand on another side of the body 510, and are electrically connected to the signal terminals 514. Specifically, the first IDC terminals 520 and the second IDC terminals 530 are inserted on the terminal block 510*b*. The terminal pressing member 540 has a row of first clamping slots 550 and a row of second clamping slots 560 on one side thereof. Each first clamping slot 550 is located on a corresponding first IDC terminal 520. Each second clamping slot 560 is located on a corresponding second IDC terminal 530.

Figure 5:
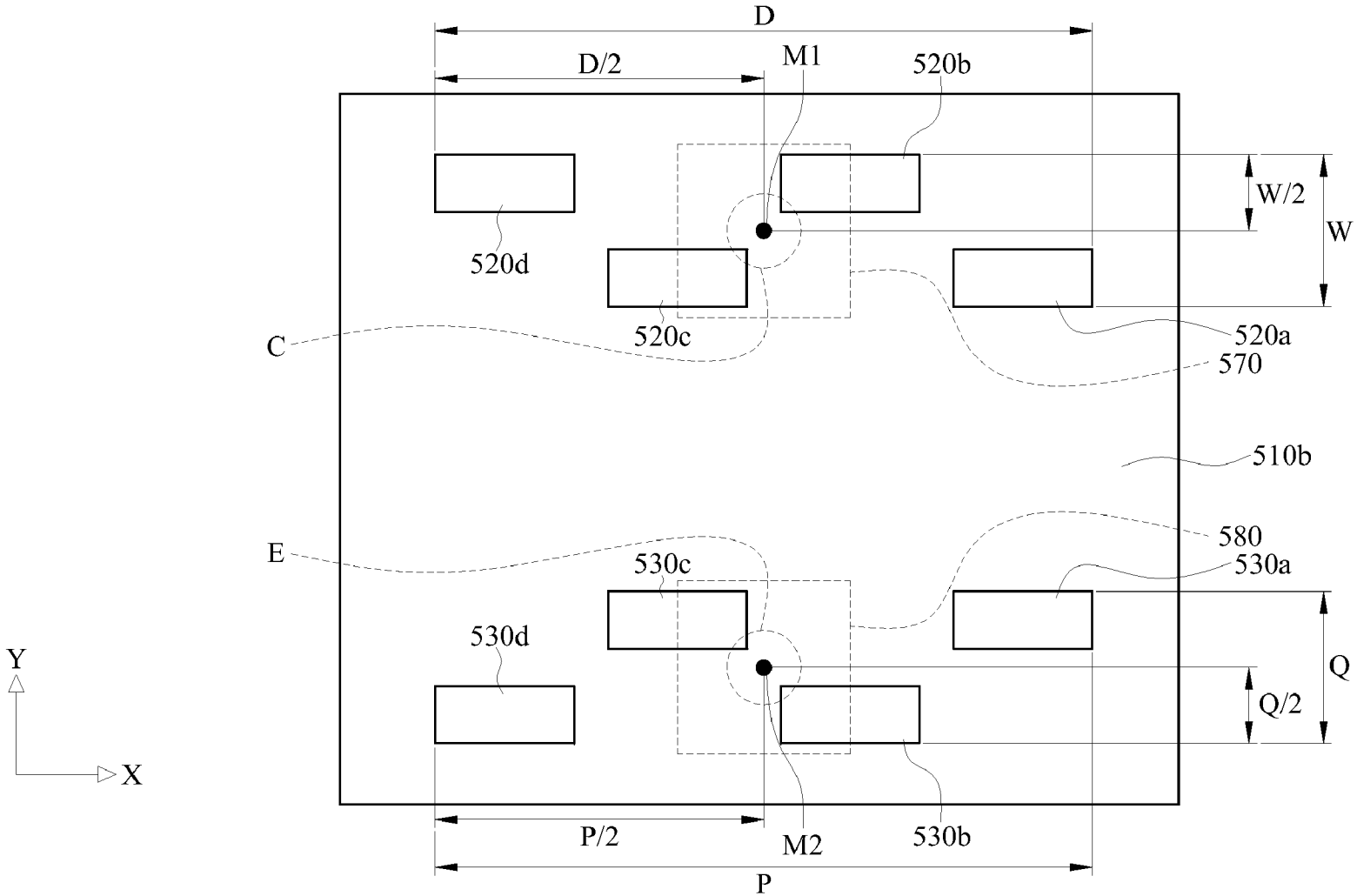
FIG. 5 is a schematic view illustrating relative positions of protrusions and IDC terminals of FIG. 4.

FIG. 5 is a schematic view illustrating relative positions of the protrusions and IDC terminals of FIG. 4. Referring to FIGS. 4 and 5, the terminal pressing member 540 has a first protruding portion 570 and a second protrusion 580 on another side thereof. In this embodiment, the first protruding portion 570 is a single convex bump, and the second protrusion 580 is also a single convex bump. However, in other embodiments of the present invention, the first protruding portion 570 may be composed of a plurality of convex bumps, and the second protrusion 580 may also be composed of a plurality of convex bumps. Further, the first protruding portion 570, for example, has a curved surface 572. In addition, the second protrusion 580 may also has a curved surface 582. Moreover, in this embodiment, a height of the first protruding portion 570 is not equal to that of the second protrusion 580. However, in another embodiment of the present invention, the height of the first protruding portion 570 may be equal to that of the second protrusion 580.

The first protruding portion 570 is located on a central area C of the first IDC terminals 520, in which the so-called "central area C" refers to an area around a central point M1 between two outermost first IDC terminals among the first IDC terminals 520. Specifically, in this embodiment, the first IDC terminals 520 are respectively the first IDC terminals

520*a*, 520*b*, 520*c*, and 520*d*, in which the first IDC terminal 520*a* and the first IDC terminal 520*d* are respectively located on the outermost side of the first IDC terminals 520. Thus, in an X-axis direction, a distance between the central point M1 and the first IDC terminal 520*d* is $$\left(\frac{D}{2}\right),$$

where D is a distance between the second IDC terminal 530*a* and the second IDC terminal 530*d* in the X-axis direction. In a Y-axis direction, a distance between the central point M1 and the first IDC terminal 520*d* is $$\left(\frac{W}{2}\right),$$

where W is a distance between the second IDC terminal 530*a* and the second IDC terminal 530*d* in the Y-axis direction. The central area C is an area of a circle with a center of the central point M1 and a radius of $$\left(\frac{D}{10}\right).$$

The second protrusion 580 is located on a central area E of the second IDC terminals 530, in which the so-called "central area E" refers to an area around a central point M2 between two outermost second IDC terminals among the second IDC terminals 530. Specifically, in this embodiment, the second IDC terminals 530 are respectively the second IDC terminals 530*a*, 530*b*, 530*c*, and 530*d*, in which the second IDC terminal 530*a* and the second IDC terminal 530*d* are located on the outermost side of the second IDC terminals 530. Thus, in the X-axis direction, a distance between the central point M2 and the second IDC terminal 530*d* is $$\left(\frac{P}{2}\right),$$

where P is a distance between the second IDC terminal 530*a* and the second IDC terminal 530*d* in the X-axis direction. In the Y-axis direction, a distance between the central point M2 and the second IDC terminals 530*d* is $$\left(\frac{Q}{2}\right),$$

where Q is a distance between the second IDC terminal 530*a* and the second IDC terminal 530*d* in the Y-axis direction. The central area E is an area of a circle with a center of the central point M2 and a radius of $$\left(\frac{P}{10}\right).$$

Referring to FIGS. 3 and 4 again, the pressing cover 590 is pivoted to the body 510 by means of a pivot 591. The pressing cover 590 has a first pressing surface 592 and a second pressing surface 594 on an inner side thereof.

With the abovementioned shield-type communication socket 500, in this embodiment, a cable 100 may be inserted in the shield-type communication socket 500 via a through hole 542 of the terminal pressing member 540, such that a plurality of conduction wires 101 in the cable 100 is electrically connected to the signal terminals 514 in the connector jack 512 by the first IDC terminals 520 and the second IDC terminals 530.

Figure 6B:
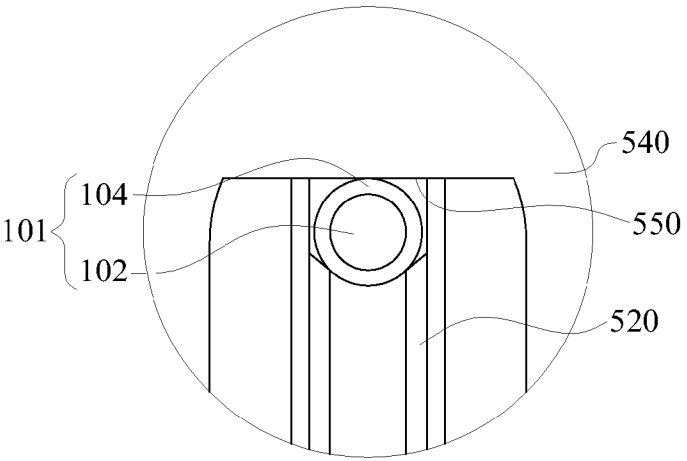
FIG. 6B is a schematic partial enlarged view of FIG. 6A.
Figure 6A:
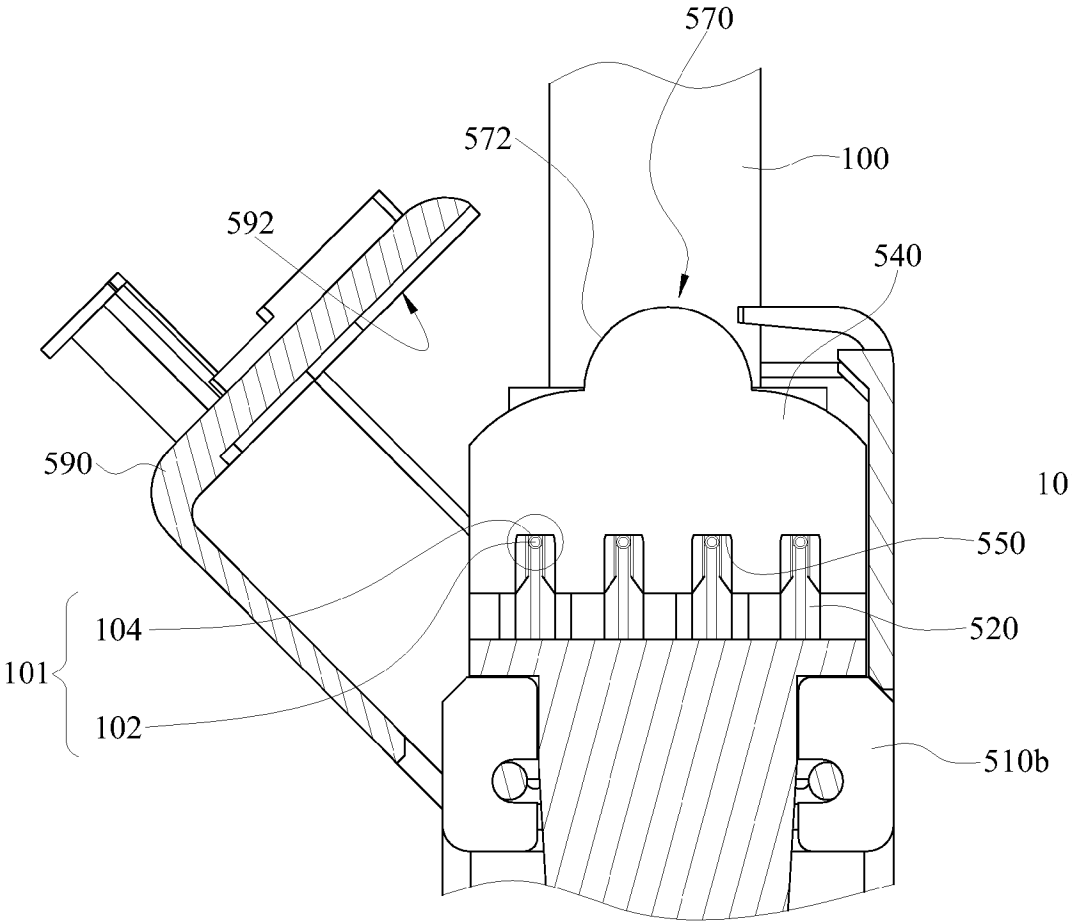
FIG. 6A is a schematic sectional view of a terminal pressing member of FIG. 3 located at a ready position relative to a body.
Figure 6D:
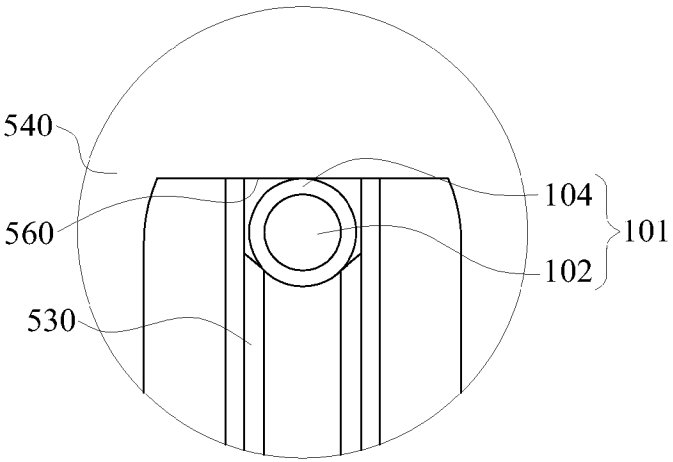
FIG. 6D is a schematic partial enlarged view of FIG. 6C.
Figure 6C:
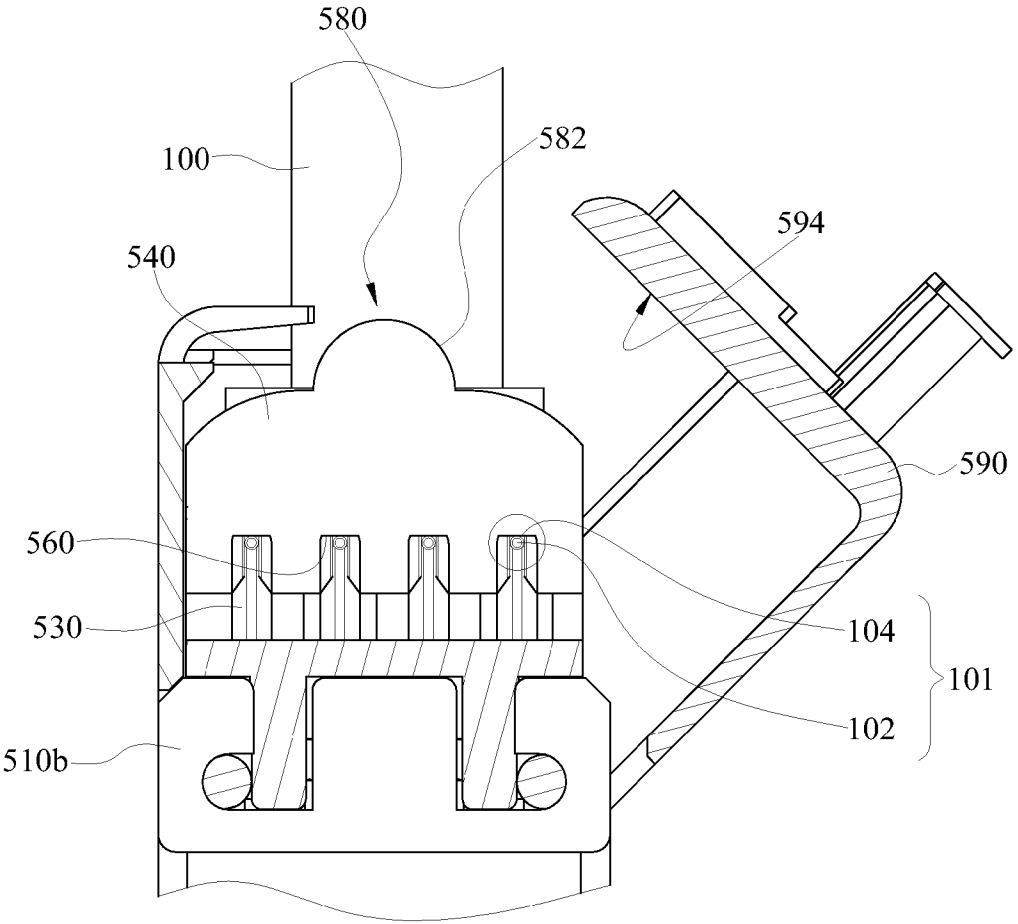
FIG. 6C is another schematic sectional view of the terminal pressing member of FIG. 3 located at a ready position relative to the body.

Referring to FIGS. 6A to 6D, FIG. 6A is a schematic sectional view of the terminal pressing member 540 of FIG. 3 located at a ready position relative to the body 510, FIG. 6B is schematic partial enlarged view of FIG. 6A, FIG. 6C is another schematic sectional view of the terminal pressing member 540 of FIG. 3 located at a ready position relative to the body 510, and FIG. 6D is a schematic partial enlarged view of FIG. 6C. With the abovementioned shield-type communication socket 500, in this embodiment, the conduction wires 101 of the cable 100 are disposed between the body 510 and the terminal pressing member 540, such that the terminal pressing member 540 is located at the ready position relative to the body 510, in which each conduction wire 101 comprises a metal wire 102 and an insulation layer 104 wrapping the metal wire 102. It should be noted that, the so-called "ready position" refers to the position of the terminal pressing member 540 relative to the body 510 when a part of the conduction wires 101 contact the first protruding portion 570 and the first IDC terminals 520 at the same time and the rest of the conduction wires 101 contact the second protrusion 580 and the second IDC terminals 530 at the same time and when the first IDC terminals 520 do not pierce the insulation layers 104.

Figure 7B:
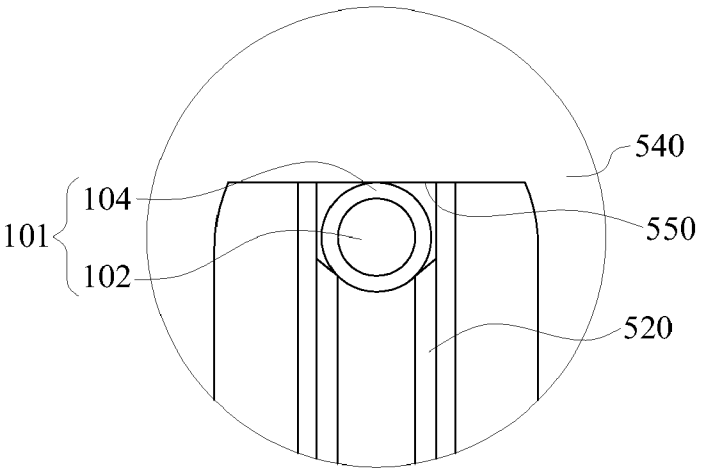
FIG. 7B is a schematic partial enlarged view of FIG. 7A.
Figure 7A:
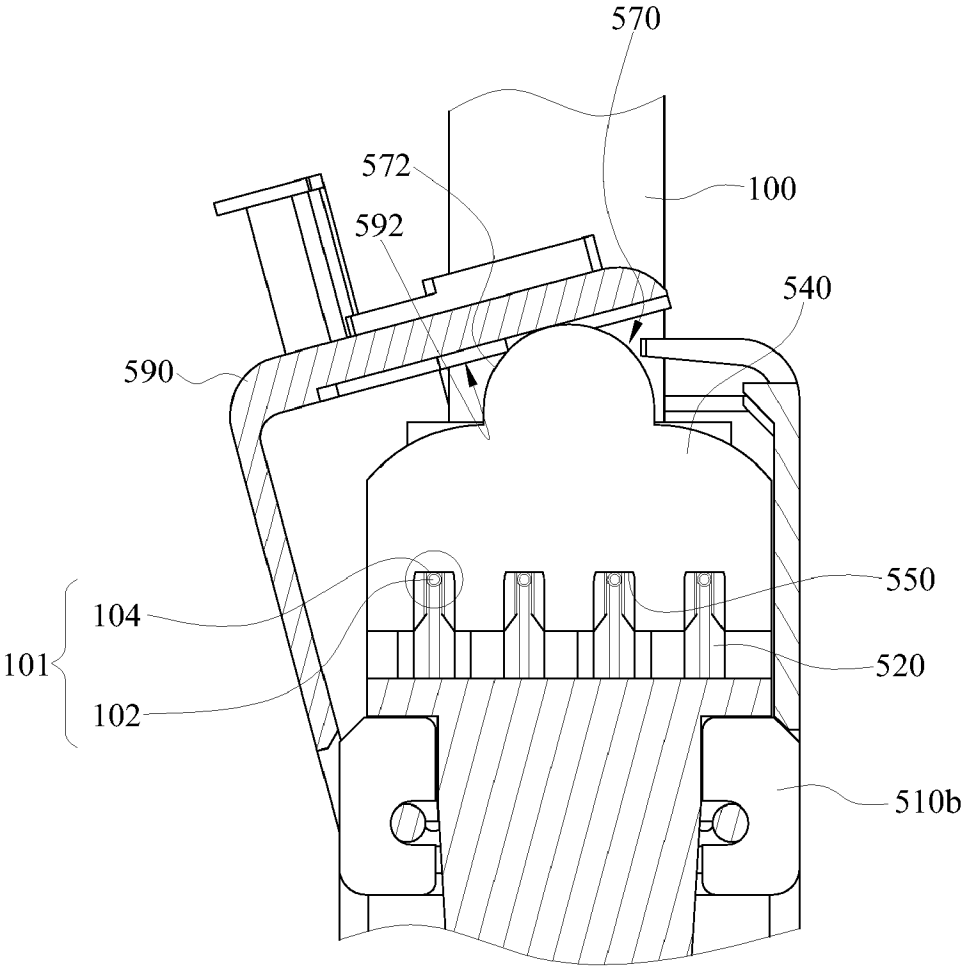
FIG. 7A is a schematic sectional view of a cover of FIG. 6A rotated to urge against a first protruding portion.
Figure 7D:
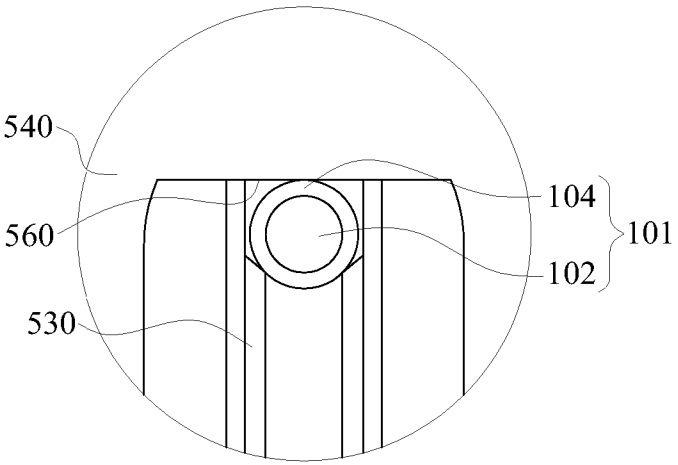
FIG. 7D is a schematic partial enlarged view of FIG. 7C.
Figure 7C:
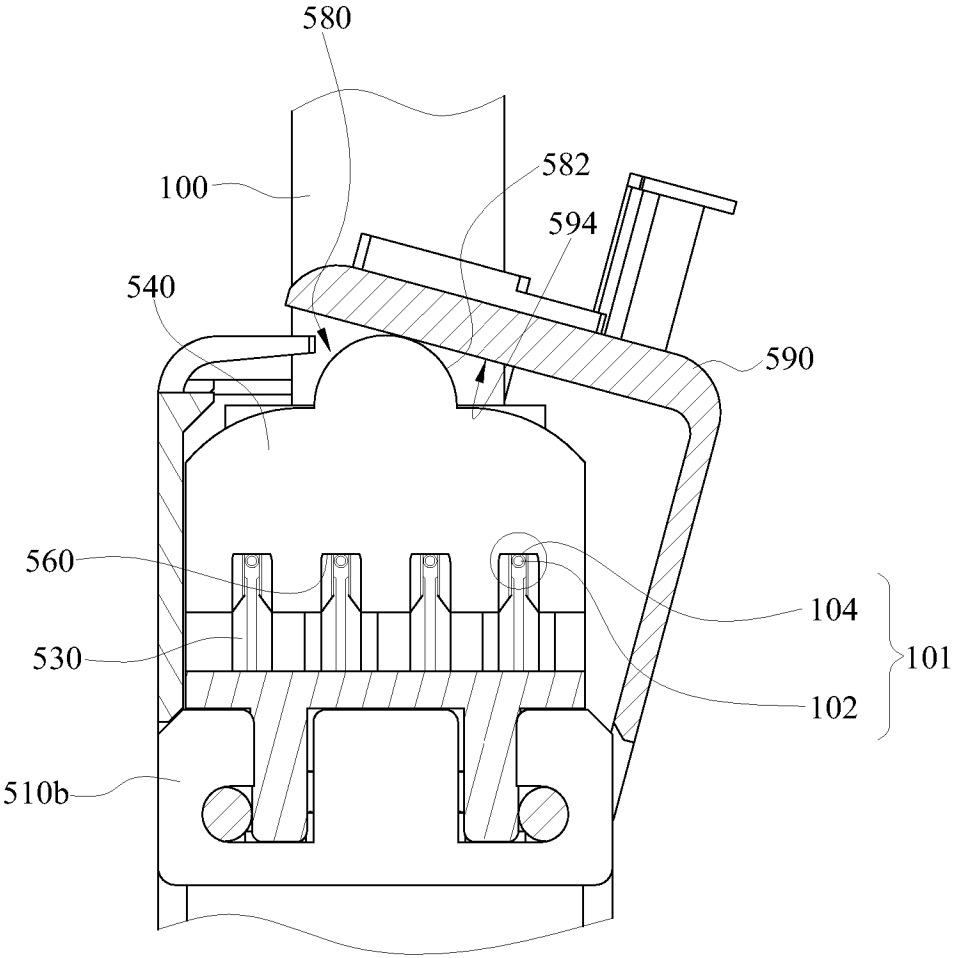
FIG. 7C is a schematic sectional view of the cover of FIG. 6C rotated to urge against a second protrusion.

Referring to FIGS. 7A to 7D, FIG. 7A is a schematic sectional view of the cover of FIG. 6A rotated to urge against the first protruding portion 570, FIG. 7B is a schematic partial enlarged view of FIG. 7A, FIG. 7C is a schematic sectional view of the cover of FIG. 6C rotated to urge against the second protrusion 580, and FIG. 7D is a schematic partial enlarged view of FIG. 7C. Then, the pressing cover 590 is rotated to make the first pressing surface 592 and the second pressing surface 594 respectively contact the first protruding portion 570 and the second protrusion 580. When the first protruding portion 570 has the curved surface 572, the first pressing surface 592 contacts the curved surface 572. In addition, when the second protrusion 580 has the curved surface 582, the second pressing surface 594 contacts the curved surface 582.

Figure 8B:
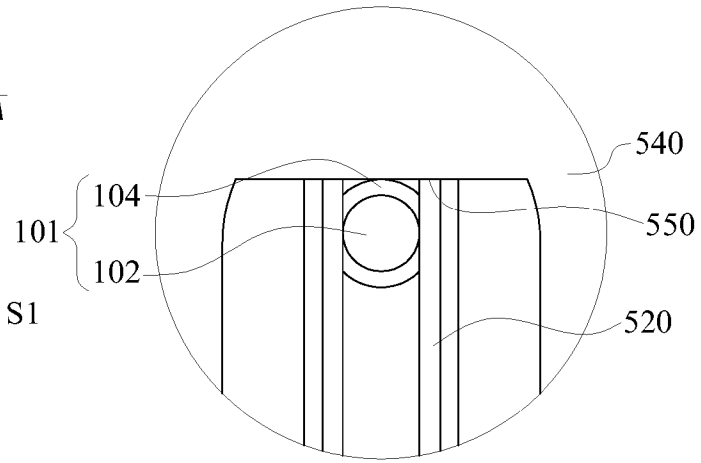
FIG. 8B is a schematic partial enlarged view of FIG. 8A.
Figure 8A:
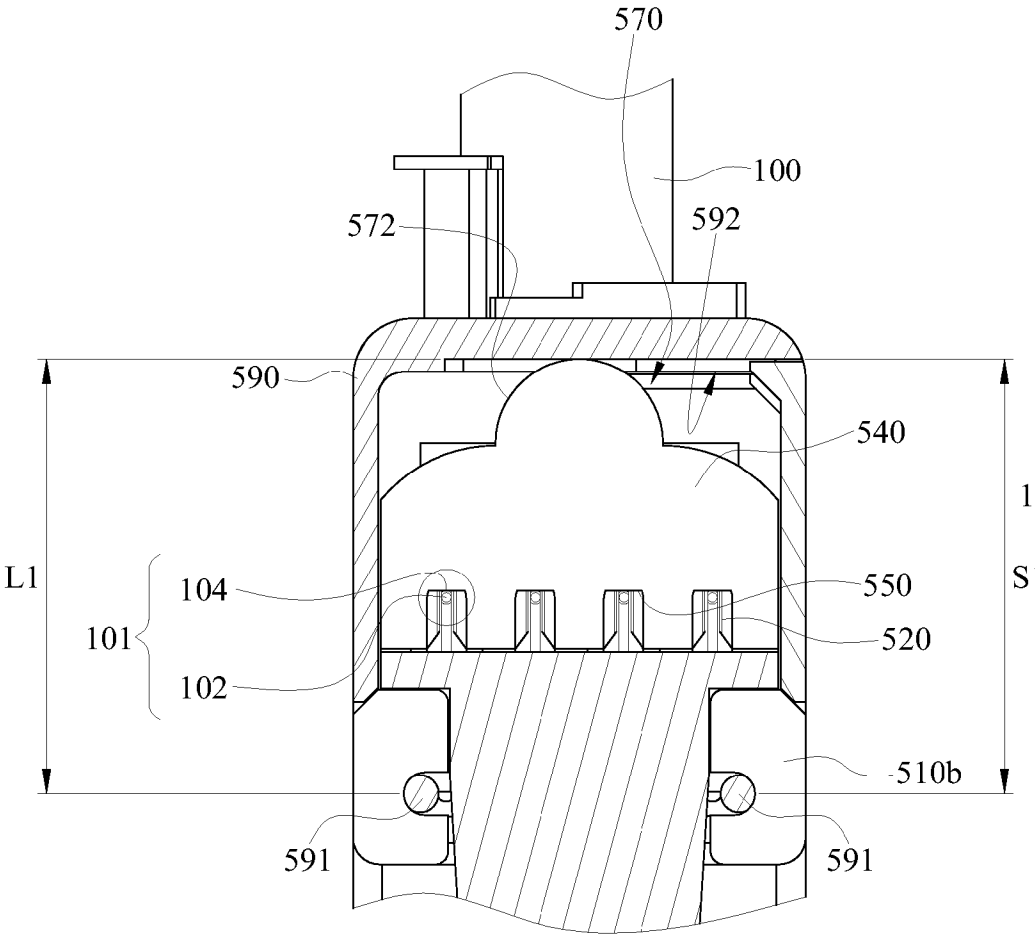
FIG. 8A is a schematic sectional view of the cover of FIG. 7A rotated to make the terminal pressing member located at a combination position relative to the body.
Figure 8D:
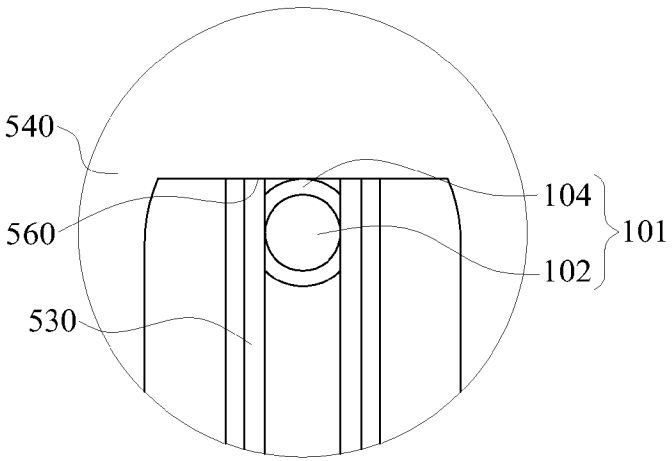
FIG. 8D is a schematic partial enlarged view of FIG. 8C.
Figure 8C:
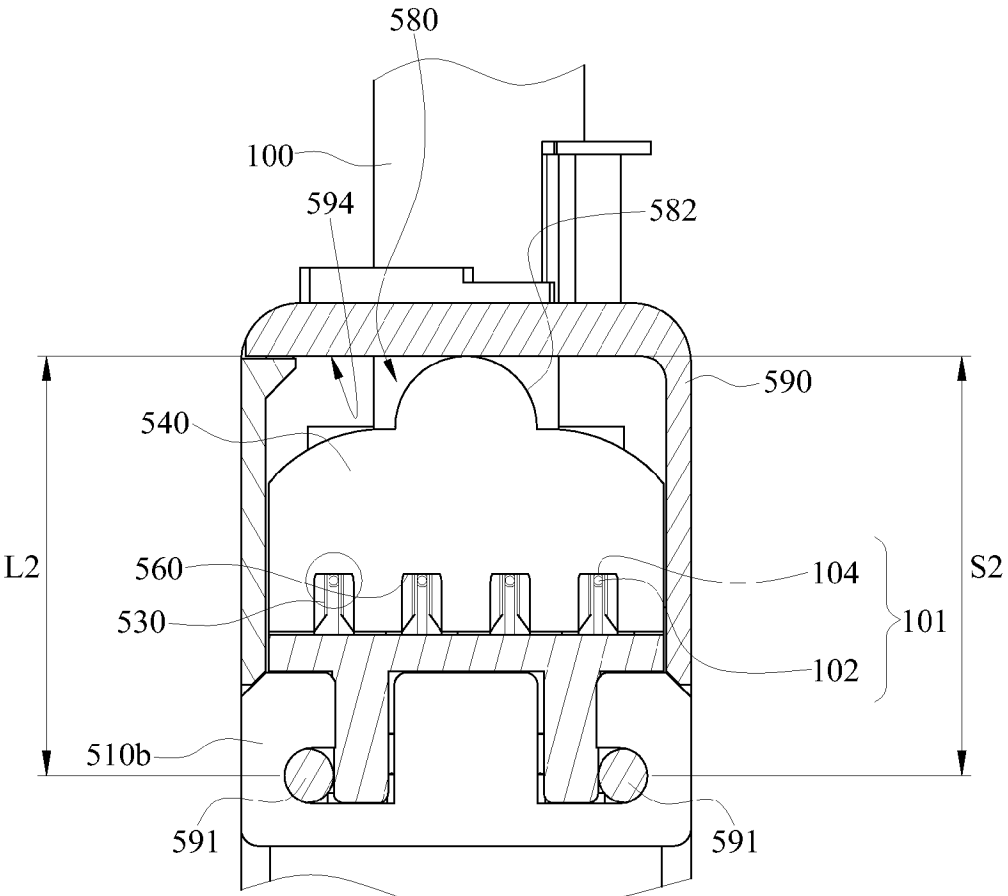
FIG. 8C is another schematic sectional view of the cover of FIG. 7C rotated to make the terminal pressing member located at a combination position relative to the body.

Referring to FIGS. 8A to 8D, FIG. 8A is a schematic sectional view of the cover of FIG. 7A rotated to make the terminal pressing member 540 located at a combination position relative to the body 510, FIG. 8B is a schematic partial enlarged view of FIG. 8A, FIG. 8C is another schematic sectional view of the cover of FIG. 7C rotated to make the terminal pressing member 540 located at a combination position relative to the body 510, and FIG. 8D is a schematic partial enlarged view of FIG. 8C. Thereafter, the pressing cover 590 is further rotated to make the first pressing surface 592 and the second pressing surface 594 exert a pressure on the first protruding portion 570 and the second protrusion 580, such that the insulation layers 104 are pressed by the first protruding portion 570 and the second protrusion 580 to be pierced by the first IDC terminals 520 and the second IDC terminals 530 until the terminal pressing member 540 is located at a combination position relative to the body 510.

In order to make all portions of the cover 590 move from the ready position to the combination position at a time and uniformly, when the terminal pressing member 540 is located at the combination position, a distance L1 between a tip end of the first protruding portion 570 and the pivot 591 is equal to a distance S1 between the first pressing surface 592 and the pivot 591, and a distance L2 between a tip end of the second protrusion 580 and the pivot 591 is equal to a distance S2 between the second pressing surface 594 and the pivot 591. Since the height of the first protruding portion 570 in this embodiment is not equal to that of the second protrusion 580, a height difference between the first protruding portion 570 and the second protrusion 580, i.e., (L1–L2), is equal to a distance difference between the first pressing surface 592 and the second pressing surface 594, i.e., (S1–S2).

It should be noted that, when the first protruding portion 570 has the curved surface 572, the first pressing surface 592 slides on the curved surface 572 until the terminal pressing member 540 is located at a combination position relative to the body 510. Likewise, when the second protrusion 580 has the curved surface 582, the second pressing surface 594 slides on the curved surface 582 until the terminal pressing member 540 is located at a combination position relative to the body 510. It should be noted that, the so-called "combination position" refers to the position of the terminal pressing member 540 relative to the body 510 when the insulation layers 104 are pierced by the first IDC terminals 520 and the second IDC terminals 530 and the metal wires 102 electrically contact the first IDC terminals 520 and the second IDC terminals 530.

Accordingly, since the first protruding portion 570 is located on the central area of the first IDC terminals 520, and the second protrusion 580 is located on the central area of the second IDC terminals 530, when the terminal pressing member 540 is driven by the pressing cover 590 to move from the ready position to the combination position, the shield-type communication socket 500 achieves the electrically contact between the metal wires 102 and the first IDC terminals 520 and the second IDC terminals 530 at a time.

Further, to facilitate the user to replace the cable 100 with different outer diameters, the shield-type communication socket 500 of this embodiment further comprises a mobile latching pin. Referring to FIG. 3 again, the pressing cover 590 has a notch 596. The shield-type communication socket 500 may further comprise a mobile latching pin 598. The mobile latching pin 598 spans on two opposite side walls forming the notch 596 of the pressing cover 590. The mobile latching pin 598 is disposed on the pressing cover 590 in a manner of being capable of moving relative to the notch 596. In this embodiment, the mobile latching pin 598 slides between a closed end 596*a* and an open end 596*b* of the notch 596 by means of a pair of slide rails 599 on the pressing cover 590.

Figure 9:
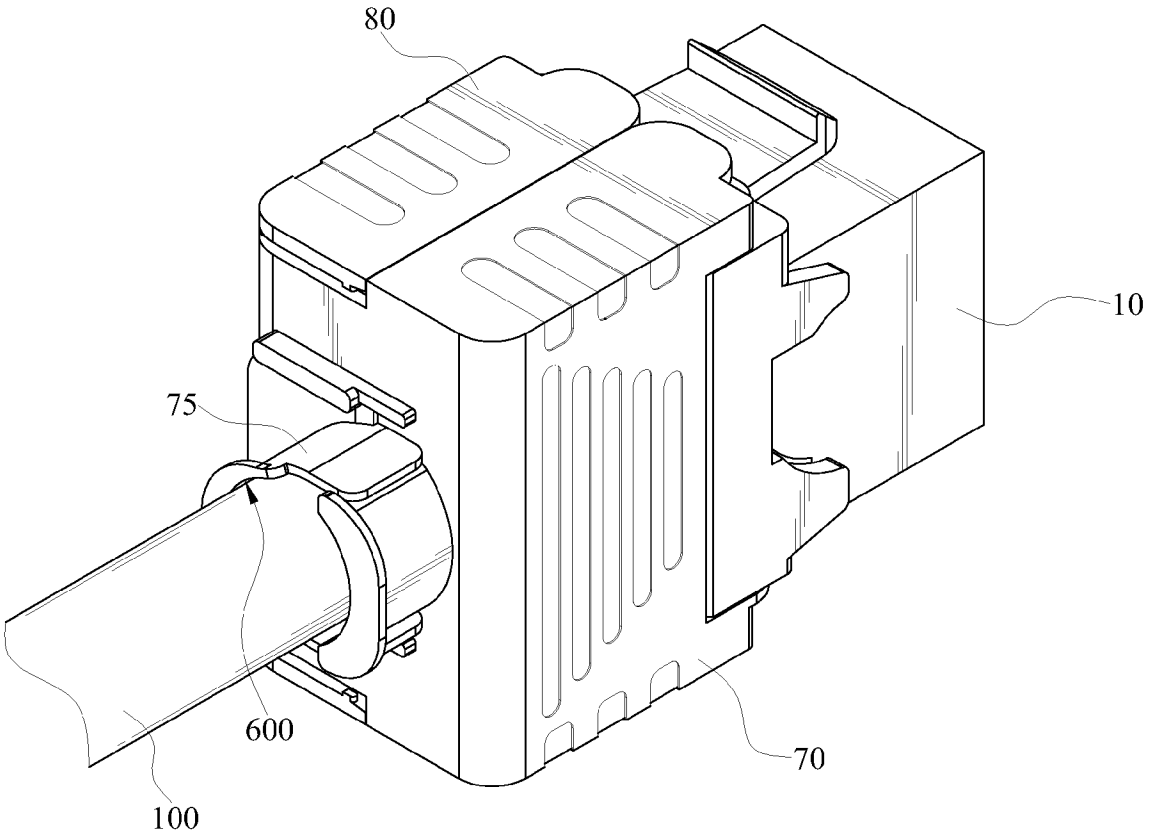
FIG. 9 is a schematic combination view of the shield-type communication socket of FIG. 3.

FIG. 9 is a schematic combination view of the shield-type communication socket of FIG. 3. Based on the design of the mobile latching pin 598, in this embodiment, the mobile latching pin 598 may slide on the pair of slide rails 599 according to the outer diameter of the cable 100, such that the mobile latching pin 598 and the notch 596 form a cable insertion hole 600 matching the outer diameter of the cable 100.

Figure 10:
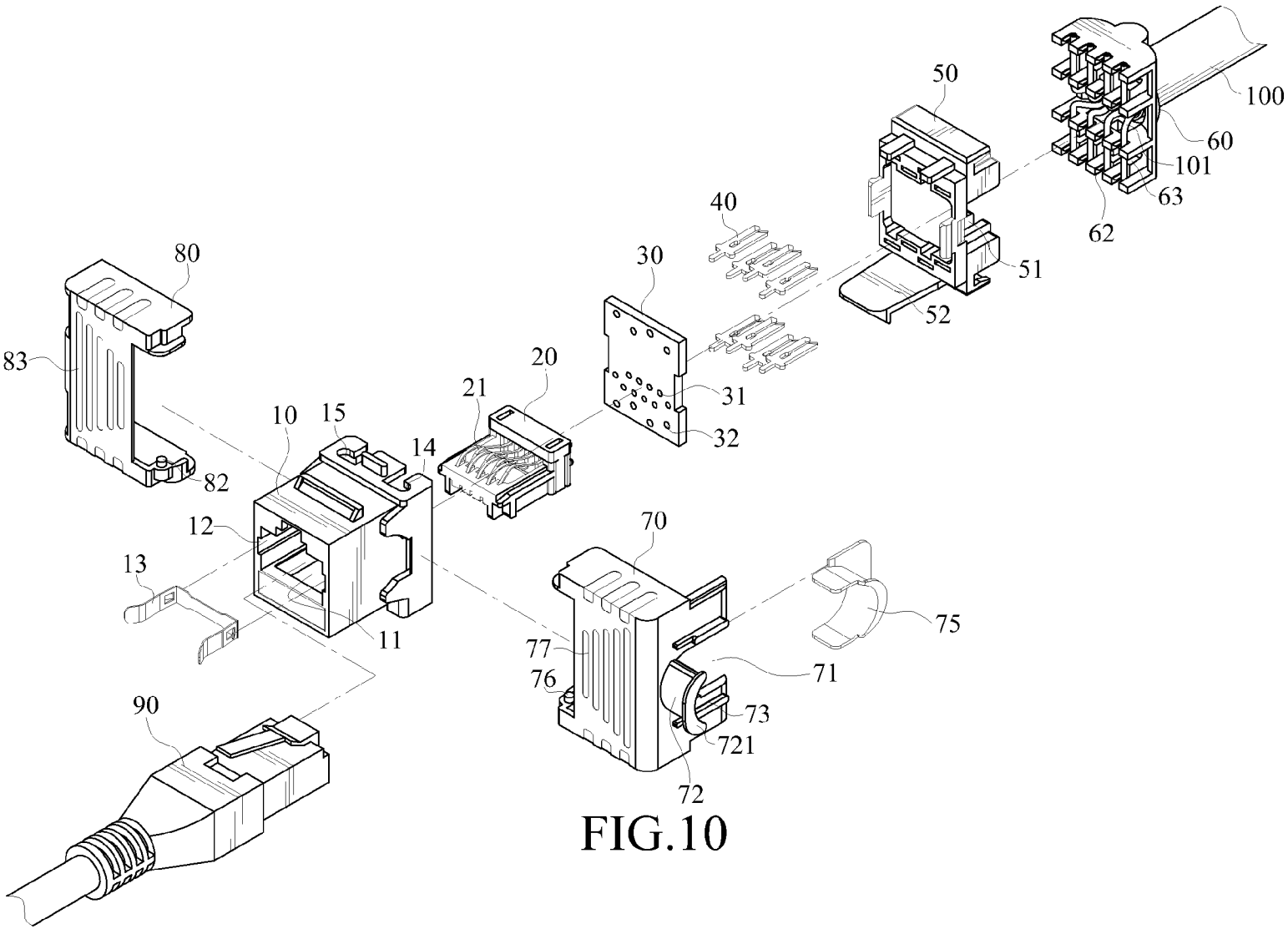
FIG. 10 is a schematic exploded front view of the shield-type communication socket according to another embodiment of the present invention.
Figure 11:
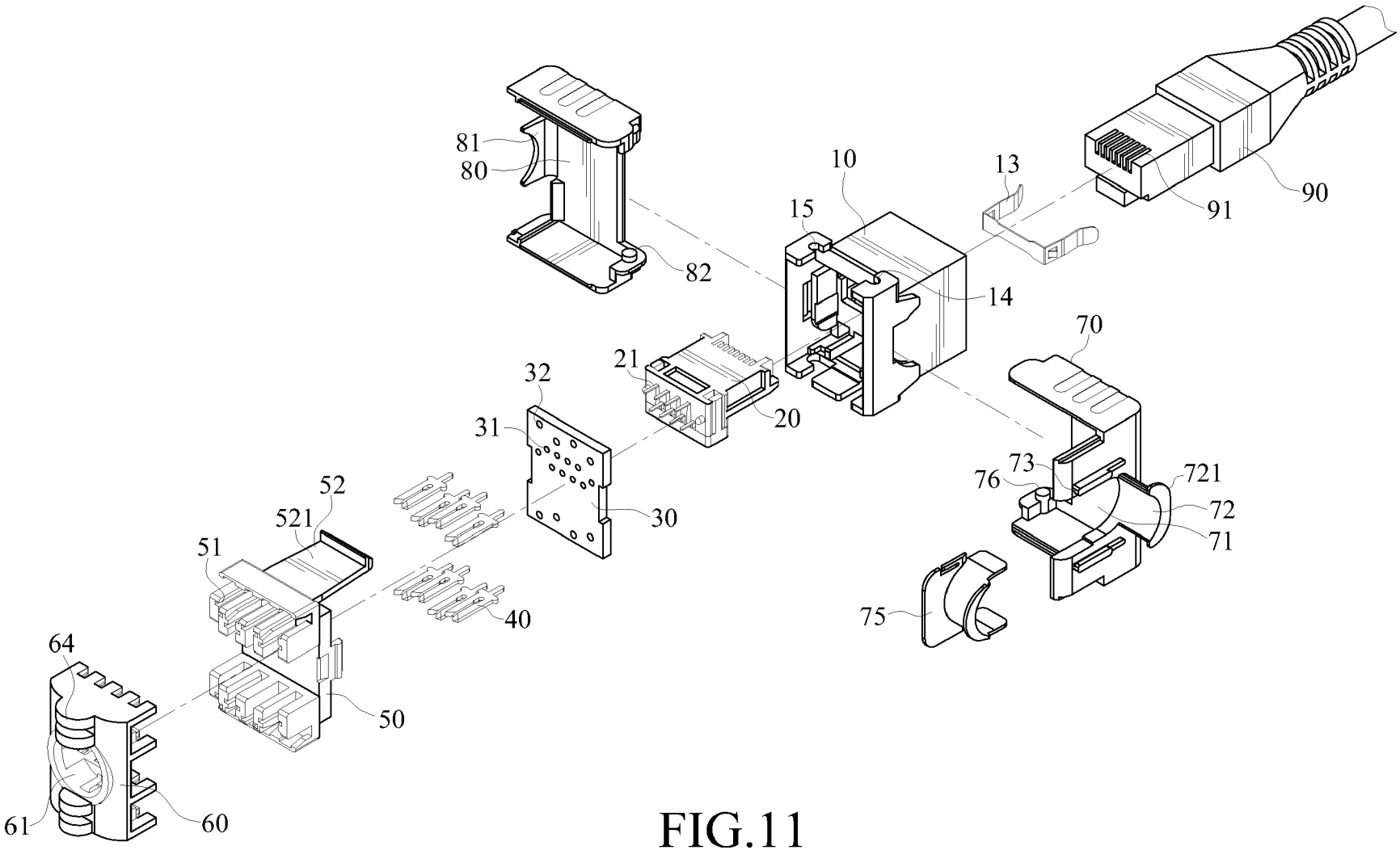
FIG. 11 is an exploded back view of the shield-type communication socket of FIG. 10.
Figure 12:
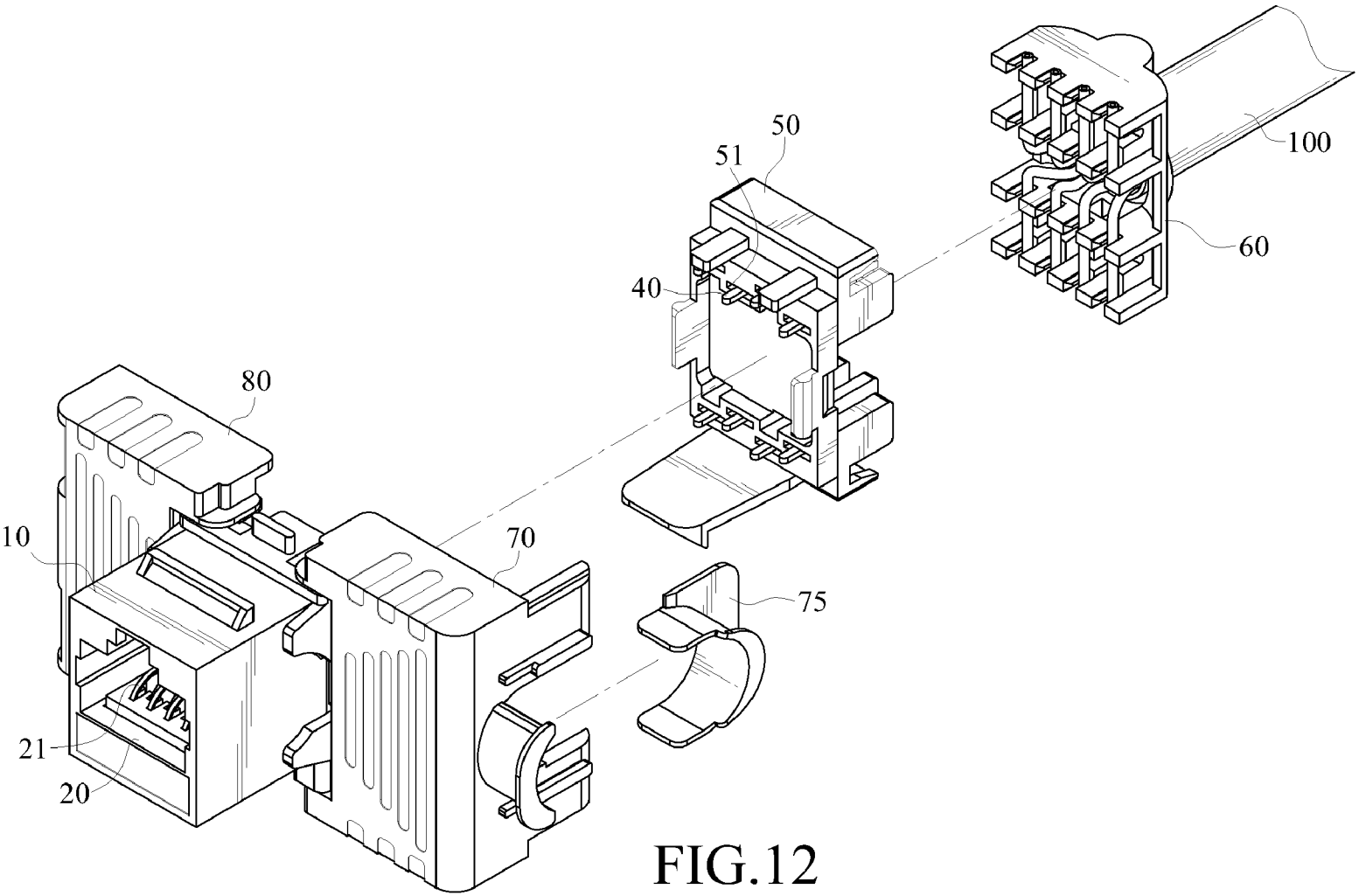
FIG. 12 is a schematic front view of a first pressing cover and a second pressing cover of FIG. 10 when combined with a housing and opened.
Figure 13:
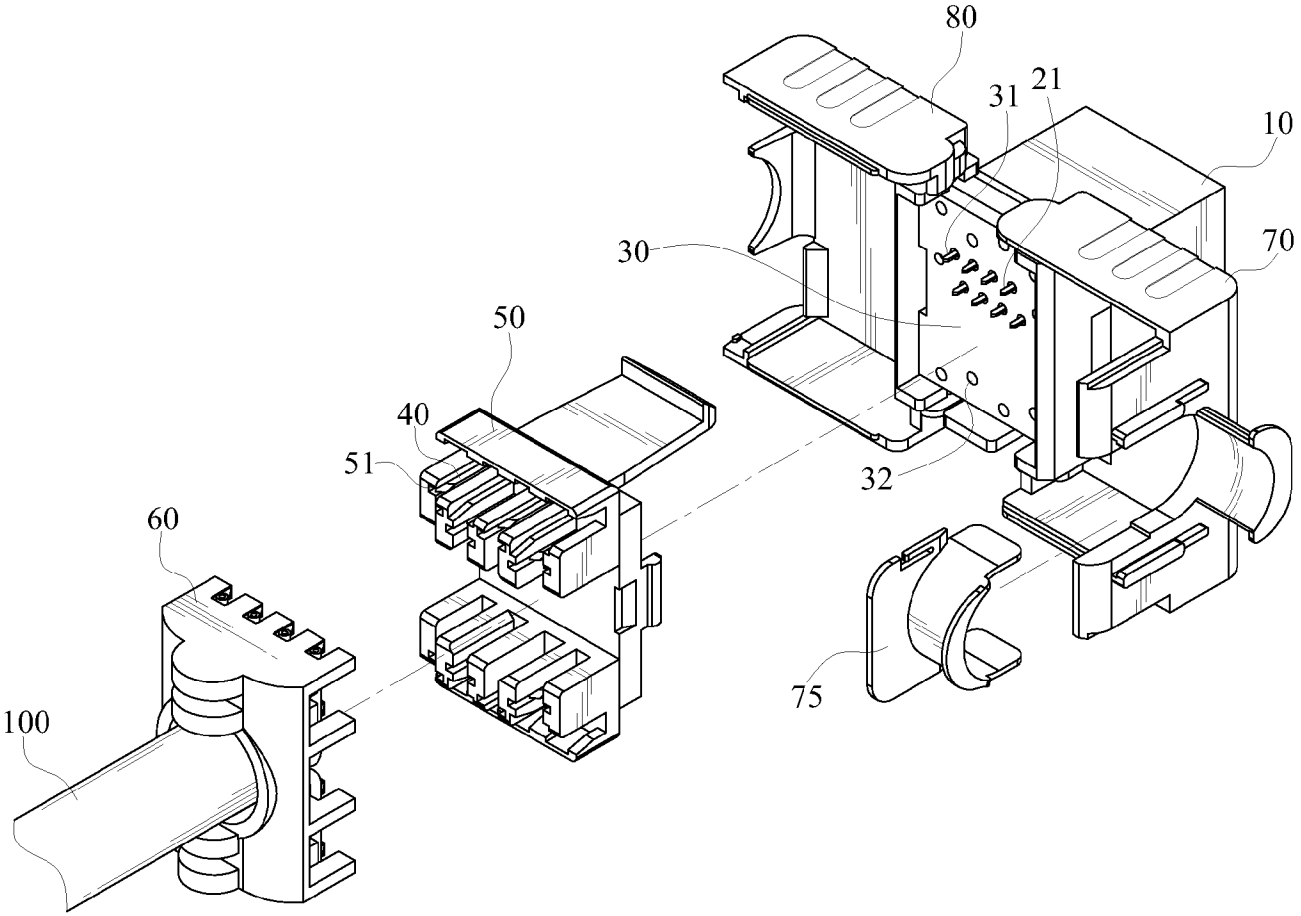
FIG. 13 is a schematic back view of the first pressing cover and the second pressing cover of FIG. 10 when combined with the housing and opened.
Figure 15:
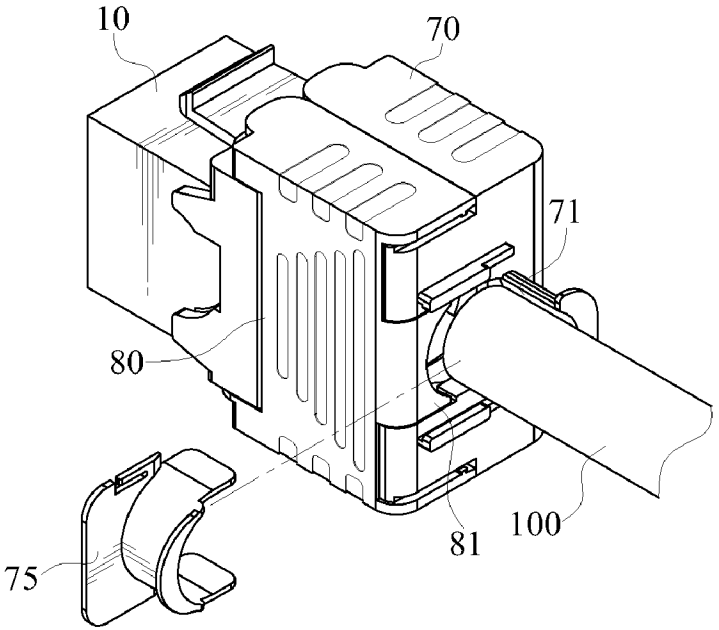
FIG. 15 is a schematic back view of the first pressing cover and the second pressing cover of FIG. 10 when combined with the housing and closed.
Figure 14:
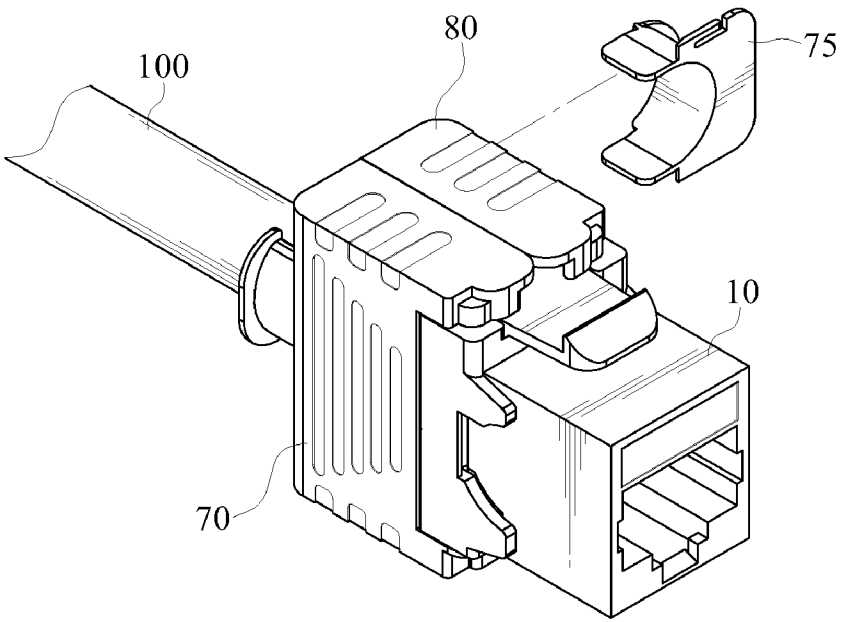
FIG. 14 is a schematic front view of the first pressing cover and the second pressing cover of FIG. 10 when combined with the housing and closed.
Figure 16:
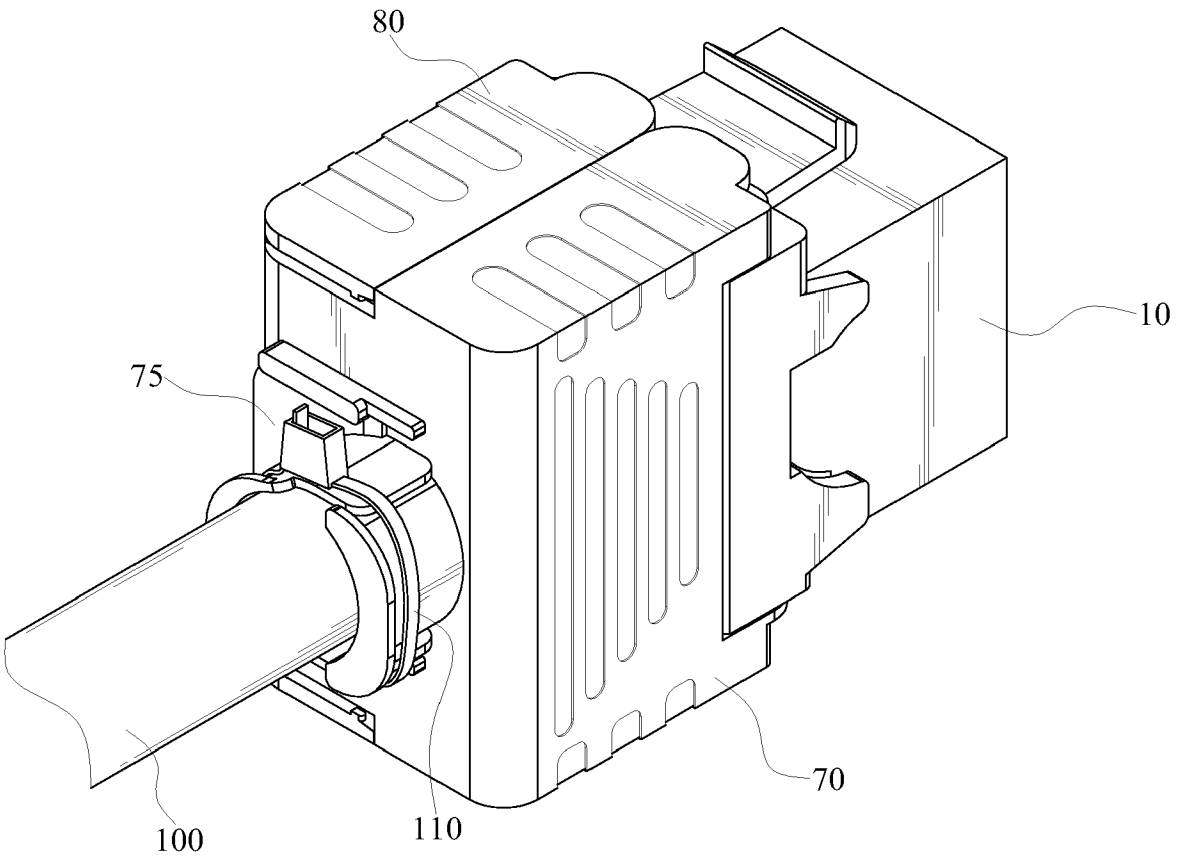
FIG. 16 is a schematic view of the shield-type communication socket of FIG. 10 combined with a cable.

Referring to FIGS. 10 to 16, FIG. 10 is a schematic exploded front view of the shield-type communication socket according to another embodiment of the present invention, FIG. 11 is an exploded back view of the shield-type communication socket of FIG. 10, FIG. 12 is a schematic front view of a first pressing cover and a second pressing cover of FIG. 10 when combined with the housing and opened, FIG. 13 is a schematic back view of the first pressing cover and the second pressing cover of FIG. 10 when combined with housing and opened, FIG. 14 is a schematic front view of the first pressing cover and the second pressing cover of FIG. 10 when combined with the housing and closed, FIG. 15 is a schematic back view of the first pressing cover and the second pressing cover of FIG. 10 when combined with the housing and closed, and FIG. 16 is a schematic view of the shield-type communication socket of FIG. 10 combined with a cable.

The shield-type communication socket as shown in FIGS. 10 to 16 is a tool-free shield-type communication socket, which is applicable to a shielded cable of CAT5 or CAT6 of a high speed network, for example but not limited to, Ethernet Network, having a transmission rate of above 250 MHz, and comprises a body, a plurality of IDC terminals 40, a terminal pressing member 60, a first pressing cover 70, and a second pressing cover 80. The body comprises a housing 10, a first terminal seat 20, a printed circuit board (PCB) 30, and a second terminal seat 50.

The housing 10 is in a rectangular shape and is made of a metal material, for example but not limited to, iron, and has a connection orifice 11 on one end thereof for plugging a connector 90. The connector 90 is, for example but not limited to, an RJ45 connector, and also has a plurality of terminals 91. The housing 10 has a slot 12 respectively on two sides thereof. The housing 10 further has a contact flat spring 13 disposed in the slot 12, so as to reinforce the combination tightness between the housing 10 and the connector 90. Preferably, the contact flat spring 13 in this embodiment is made of an electrically conductive material. Therefore, when the connector 90 is inserted in the housing 10 via the connection orifice 11, the connector 90 electrically contacts the contact flat spring 13 and is electrically connected to the housing 10 through the contact flat spring 13, so that the connector 90 is grounded to the housing 10.

Moreover, the housing 10 further has a first buckling portion 14 and a second buckling portion 15 on the upper and lower sides thereof, so as to respectively lock the first pressing cover 70 and the second pressing cover 80.

The first terminal seat 20 may be placed in the housing 10, and has a plurality of first terminals 21 to be electrically connected to the terminals 91 on the connector 90. One end of each first terminal 21 is bent to form a resilient sheet, and the other end is plugged and retained on the PCB 30.

The PCB 30 is placed on one side of the first terminal seat 20, for example but not limited to, the left side, and has a plurality of first openings 31 and a plurality of second openings 32. The plurality of first openings 31 is provided for plugging and retaining the plurality of first terminals 21. The PCB 30 further has a circuit (not shown) for connecting the plurality of first terminals 21 to the plurality of IDC terminals 40.

The plurality of IDC terminals 40 is placed on one side of the PCB 30, for example but not limited to, the right side, and one end of each IDC terminal 40 is respectively plugged and retained in the plurality of second openings 32.

The second terminal seat 50 is placed on one side of the plurality of IDC terminals 40, for example but not limited to, the right side, and has a plurality of insertion slots 51 for respectively accommodating the plurality of IDC terminals 40. The second terminal seat 50 further has a tongue sheet 52 extending therefrom on another side different form the side having the plurality of insertion slots 51. The tongue sheet 52 may be exposed outside the housing 10, and further has a direction indicator 521, for example but not limited to, UP for indicating the direction of the socket.

The terminal pressing member 60 is placed on one side of the second terminal seat 50, for example but not limited to, the right side, and has a through hole 61, a plurality of clamping slots 62, and a plurality of clamping slots 63. The through hole 61 is provided for a cable 100 to penetrate, the cable 100 has a plurality of conduction wires 101, and the plurality of clamping slots 62 is corresponding to the plurality of insertion slots 51 and provided for clipping the conduction wires 101. The number of the plurality of first terminals 21, the plurality of first openings 31, the plurality of second openings 32, the plurality of IDC terminals 40, the plurality of insertion slots 51, the plurality of clamping slots 62, the plurality of clamping slots 63, and the plurality of conduction wires 101 are respectively eight, which is described in the prior art and is not the key point of the present invention so the details thereof will not be described herein again.

The terminal pressing member 60 further has a plurality of convex bumps 64 on one side different from the side having the plurality of clamping slots 62 and the plurality of clamping slots 63, and the number of the convex bumps 64 is, for example but not limited to, four, and the convex bumps 64 are evenly distributed on two sides of the through hole 61.

The first pressing cover 70 is rotatably pivoted on one side of the housing 10, for example but not limited to, the left side, and has an arc-shaped breach 71, and one side of the arc-shaped breach 71 extends outwards to form a fastening member 72. The fastening member 72 has two guiding slots 73 respectively on two sides thereof, and further has a mobile latching pin 75 capable of moving in the two guiding slots 73 for dynamically adjusting the space between the fastening member 72 and the mobile latching pin 75. An end portion of the fastening member 72 further extends outwards to form a blocking sheet 721 for stopping and retaining a cable tie 110. The first pressing cover 70 further has a first protruding portion 76 corresponding to the first buckling portion 14 on the upper and lower sides thereof, such that through the combination of the first protruding portion 76 and the first buckling portion 14, the first pressing cover 70 is rotatably pivoted on one side of the housing 10. In addition, the first pressing cover 70 further has a plurality of anti-slippery slots 77 for increasing the force of friction in installation.

The second pressing cover 80 is rotatably pivoted on another side of the housing 10, for example but not limited to, the right side, and has an arc-shaped protruding 81 which may be combined with the arc-shaped breach 71 to accommodate the cable 100. The second pressing cover 80 further has a second protrusion 82 corresponding to the second buckling portion 15 on the upper and lower sides thereof, for respectively locking the housing 10, such that through the combination of the second protrusion 82 and the second buckling portion 15, the second pressing cover 80 is rotatably pivoted on another side of the housing 10. In addition, the second pressing cover 80 further has a plurality of anti-slippery slots 83 for increasing the force of friction in installation.

Referring to FIGS. 12 and 13, in assembling, the plurality of first terminals 21 on the first terminal seat 20 is first respectively inserted and retained in the plurality of first openings 31 of the PCB 30. Then, the first terminal seat 20 and the PCB 30 are placed in the housing 10. The plurality of IDC terminals 40 is retained in the plurality of insertion slots 51 on the second terminal seat 50. The first terminals 21 are respectively inserted and retained in the plurality of first openings 31, and then respectively inserted and retained in the plurality of second openings 32 of the PCB 30. Afterwards, the first pressing cover 70 is pivoted on the left side of the housing 10, and the second pressing cover 80 is pivoted on the right side of the housing 10. Thus, the assembly of the shield-type communication socket of the present invention is completed.

Referring to FIGS. 14 and 15, when the shield-type communication socket of the present invention is closed, the first pressing cover 70 and the second pressing cover 80 are closed to make the arc-shaped protruding 81 and the arc-shaped breach 71 combined to form a round hole for accommodating the cable 100. Finally, the mobile latching pin 75 is placed in the guiding slot 73 and moves therein for dynamically adjusting the space between the fastening member 72 and the mobile latching pin 75.

Referring to FIG. 16, when the shield-type communication socket of the present invention is combined with the cable 100, the plurality of conduction wires 101 of the cable 100 is first respectively placed in the plurality of clamping slots 62 of the terminal pressing member 60. Then, the plurality of clamping slots 62 on the terminal pressing member 60 is aligned with the plurality of insertion slots 51 of the second terminal seat 50 and is applied with a force for tightening, and the plurality of clamping slots 62 presses the plurality of conduction wires 101 into the plurality of insertion slots 51. Afterwards, the first pressing cover 70 and the second pressing cover 80 are closed, and the first pressing cover 70 and the second pressing cover 80 are utilized to single-sidedly and evenly exert a force on the plurality of convex bumps 64 to make the plurality of IDC terminals 40 pierce the conduction wires 101 and conducted with the plurality of first terminals 21, and make the arc-shaped protruding 81 and the arc-shaped breach 71 combined to form a round hole for accommodating the cable 100. Then, the mobile latching pin 75 is placed in the guiding slot 73 and moves therein, for dynamically adjusting the space between the fastening member 72 and the mobile latching pin 75. Finally, the cable tie 110 tightens the fastening member 72, the mobile latching pin 75, and the cable 100, and the cable tie 110 is stopped and fixed by the blocking sheet 721. Thus, the connection of the shield-type communication socket of the present invention and the cable 100 is completed. Therefore, the shield-type communication socket of the present invention has inventiveness as compared with the shield-type communication socket in the prior art.

In view of the above, since the first protruding portion is located on the central area of the first IDC terminals, and the second protrusion is located on the central area of the second IDC terminals, when the terminal pressing member is driven by the pressing cover to move from the ready position to the combination position, the shield-type communication socket may complete the electrical contact between the metal wires and the first IDC terminals and the second IDC terminals at a time.

In addition, when the present invention has the design of the mobile latching pin, since the mobile latching pin is disposed on the pressing cover in a manner of being capable of moving relative to the notch, the user may adjust the size of the cable insertion hole formed by the mobile latching pin and the notch to meet the outer diameter of the desired cable.

What is claimed is:

1. A shield-type communication socket, comprising:

a body, having a connector jack on one side thereof, the connector jack comprising a plurality of signal terminals;

a plurality of first Insulation Displacement Contact (IDC) terminals and second IDC terminals, electrically connected to the signal terminals;

a terminal pressing member, having a plurality of first clamping slots and second clamping slots on one side thereof, wherein the first clamping slots are located on the first IDC terminals and the second clamping slots are located on the second IDC terminals, and having a first protruding portion and a second protrusion on another side thereof, wherein the first protruding portion is located on a central area of the first IDC terminals and the second protrusion is located on a central area of the second IDC terminals; and a pressing cover, pivoted to the body and having a first pressing surface and a second pressing surface on an inner side thereof, wherein when the terminal pressing member is located at a ready position, the pressing cover is rotated to make the first pressing surface and the second pressing surface respectively press the first protruding portion and the second protrusion, such that the terminal pressing member moves to a combination position.

2. The shield-type communication socket according to claim 1, wherein the first protruding portion has a curved surface, and the pressing surface presses the terminal pressing member from the ready position to the combination position along the curved surface.

3. The shield-type communication socket according to claim 1, wherein the first protruding portion comprises a plurality of convex bumps.

4. The shield-type communication socket according to claim 1, wherein a height of the first protruding portion is greater than that of the second protrusion.

5. The shield-type communication socket according to claim 1, further comprising a mobile latching pin, wherein the pressing cover has a notch, the mobile latching pin spans on two opposite side walls forming the notch, such that the mobile latching pin and the notch form a cable insertion hole, and the mobile latching pin is disposed on the pressing cover in a manner of being capable of moving relative to the notch, such that the mobile latching pin slides between a closed end and an open end of the notch.

* * * * *